US008308930B2

(12) United States Patent
Kim et al.

(10) Patent No.: US 8,308,930 B2
(45) **Date of Patent: *Nov. 13, 2012**

(54) MANUFACTURING CARBON NANOTUBE ROPES

(75) Inventors: Yong Hyup Kim, Seoul (KR); Tae June Kang, Seoul (KR); Eui Yun Jang, Jeju-do (KR)

(73) Assignee: SNU R&DB Foundation, Seoul (KR)

( * ) Notice: Subject to any disclaimer, the term of this patent is extended or adjusted under 35 U.S.C. 154(b) by 593 days.

This patent is subject to a terminal disclaimer.

(21) Appl. No.: 12/233,339

(22) Filed: Sep. 18, 2008

(65) Prior Publication Data

US 2009/0223826 A1 Sep. 10, 2009

(30) Foreign Application Priority Data

Mar. 4, 2008 (KR) ..... 10-2008-0020122
Aug. 29, 2008 (KR) ..... 10-2008-0085539

(51) Int. Cl.
*C25D 5/00* (2006.01)
*C25D 5/54* (2006.01)
*C25D 15/00* (2006.01)
*D01F 9/12* (2006.01)

(52) U.S. Cl. ..... 205/96; 205/109; 205/159; 423/447.1; 977/845; 977/742

(58) Field of Classification Search ..... None
See application file for complete search history.

(56) References Cited

U.S. PATENT DOCUMENTS 4,841,786 A 6/1989 Schulz
5,763,879 A 6/1998 Zimmer et al.
5,948,360 A 9/1999 Rao et al.
6,781,166 B2 8/2004 Lieber et al.
6,905,667 B1 6/2005 Chen et al.
7,054,064 B2 5/2006 Jiang et al.
7,147,894 B2 12/2006 Zhou et al.
7,164,209 B1 1/2007 Duan et al.
7,288,317 B2 10/2007 Poulin et al.
7,385,295 B2 6/2008 Son et al.
2002/0014667 A1 2/2002 Shin et al.
2002/0069505 A1 6/2002 Nakayama et al.
2002/0127162 A1 9/2002 Smalley et al.
2003/0122111 A1 7/2003 Glatkowski
2003/0161950 A1 8/2003 Ajayan et al.

(Continued)

FOREIGN PATENT DOCUMENTS

CN 1849181 A 10/2006

(Continued)

OTHER PUBLICATIONS

Annamalai, et al., "Electrophoretic drawing of continuous fibers of single-walled carbon nanotubes," *J. Appl. Phys.*, 98 114307-1 through 114307-6 (2005).

(Continued)

*Primary Examiner* — Jonathan Johnson
*Assistant Examiner* — Brian W Cohen
(74) *Attorney, Agent, or Firm* — Knobbe, Martens, Olson & Bear, LLP

(57) ABSTRACT

Techniques for manufacturing carbon nanotube (CNT) ropes are provided. In some embodiments, a CNT rope manufacturing method optionally includes preparing a metal tip, preparing a CNT colloid solution, immersing the metal tip into the CNT colloid solution; and withdrawing the metal tip from the CNT colloid solution.

22 Claims, 8 Drawing Sheets

U.S. PATENT DOCUMENTS

| | | | | |
|---|---|---|---|---|
| 2004/0053780 | A1 | 3/2004 | Jiang et al. | |
| 2004/0173378 | A1 | 9/2004 | Zhou et al. | |
| 2004/0265550 | A1 | 12/2004 | Glatkowski et al. | |
| 2006/0060825 | A1 | 3/2006 | Glatkowski | |
| 2006/0099135 | A1 | 5/2006 | Yodh et al. | |
| 2006/0113510 | A1 | 6/2006 | Luo et al. | |
| 2006/0133982 | A1 | 6/2006 | Kinloch et al. | |
| 2006/0274048 | A1 | 12/2006 | Spath et al. | |
| 2007/0007142 | A1 | 1/2007 | Zhou et al. | |
| 2007/0014148 | A1 | 1/2007 | Zhou et al. | |
| 2007/0020458 | A1 | 1/2007 | Su et al. | |
| 2007/0045119 | A1 | 3/2007 | Sandhu | |
| 2007/0243124 | A1 | 10/2007 | Baughman et al. | |
| 2007/0248528 | A1 | 10/2007 | Kim | |
| 2008/0000773 | A1 | 1/2008 | Lee et al. | |
| 2008/0044651 | A1 | 2/2008 | Douglas | |
| 2008/0044775 | A1 | 2/2008 | Hong et al. | |
| 2008/0048996 | A1 | 2/2008 | Hu et al. | |
| 2008/0088219 | A1 | 4/2008 | Yoon et al. | |
| 2008/0171193 | A1 | 7/2008 | Yi et al. | |
| 2008/0290020 | A1 | 11/2008 | Marand et al. | |
| 2009/0059535 | A1 | 3/2009 | Kim et al. | |
| 2010/0040529 | A1 | 2/2010 | Kim et al. | |
| 2010/0140097 | A1 * | 6/2010 | Wei et al. ..... | 205/50 |

FOREIGN PATENT DOCUMENTS

| | | | |
|---|---|---|---|
| DE | 69728410 | T2 | 12/1998 |
| JP | 2002301700 | A | 10/2002 |
| JP | 2005061859 | A | 3/2005 |
| JP | 2005255985 | A | 9/2005 |
| JP | 2006513048 | A | 4/2006 |
| JP | 3868914 | B2 | 1/2007 |
| JP | 2008103329 | A | 5/2008 |
| JP | 2008177165 | A | 7/2008 |
| KR | 1020050097711 | A | 10/2005 |
| KR | 20070072222 | A | 7/2007 |
| KR | 1020070112733 | | 11/2007 |
| KR | 1020080063194 | A | 7/2008 |
| KR | 101085276 | B1 | 11/2011 |

OTHER PUBLICATIONS

Brioude, et al., "Synthesis of sheathed carbon nanotube tips by the sol-gel technique," Applied Surface Science, 221, 2004, pp. 4-9.

Dong, et al., "Synthesis, assembly and device of 1-dimentional nanostructures," *Chinese Science Bulletin*, 47(14), 2002, pp. 1149-1157.

Goldstein et al., "Zero TCR Foil Resistor Ten Fold Improvement in Temperature Coefficient", Electronic Components and Tech. Conf., IEEE, 2001.

Hulman et al., The dielectrophoretic attachment of nanotube fibres on tungsten needles, Mar. 6, 2007, Nanotechnology, 18, 1-5.

Im, et al., "Directed-assembly of Single-walled Carbon Nanotubes Using Self-assembled Monolayer Patterns Comprising Conjugated Molecular Wires," *Nanotechnology*, (2006) vol. 17: pp. 3569-3573.

International Search Report dated Mar. 5, 2009 for corresponding PCT Application No. PCT/KR2008/007144 filed Dec. 3, 2008.

Jiang et al., "Spinning continuous carbon nanotube yarns", Nature, vol. 419, 801 (2002).

Kaempgen et al., "Transparent carbon nanotube coatings," Applied Surface Science 252; pp. 425-429 (2005).

Kang et al., "Sandwich-Type Laminated Nanocomposites Developed by Selective Dip-Coating of Carbon Nanotubes", Adv. Mater., 19, 427-432 (2007).

Ko et al., "Electrospinning of Continuous Carbon Nanotube-Filled Nanofiber Yarns", Adv. Mater., 15, No. 14, pp. 1161-1165 (2003).

Kornev, et al., "Ribbon-to-Fiber Transformation in the Process of Spinning of Carbon-Nanotube Dispersion," *Physical Review Letters*, 97, 188303-1 through 188303-4, 2006.

Kumar et al., "Search for a novel zero thermal expansion material: dilatometry of the AgI-CuI system", J. Mater Sci. 41, pp. 3861-3865 (2006).

Kwon et al., "Thermal Contraction of Carbon Fullerenes and Nanotubes", Phy. Rev. Lett., vol. 92, No. 1, pp. 015901-015904 (2004).

Kwon, "Computational Modeling and Applications of Carbon Nanotube Devices", NSI Workshop Series—IV, Jul. 11, 2007.

Lee et al., "Linker-free directed assembly of high-performance integrated devices based on nanotubes and nanowires", Nature Nanotechnology, vol. 1, pp. 66-71, Oct. 2006.

Lewenstein, et al., "High-yield Selective Placement of Carbon Nanotubes on Pre-patterned Electrodes," *NanoLetters*, (2002) vol. 2, Issue (5): pp. 443-446.

Li et al., "Direct Spinning of carbon Nanotube Fibers from Chemical Vapor Deposition Synthesis", Science, vol. 304, 276-278 (2004).

Liu et al., "Controlled deposition of individual single-walled carbon nanotubes on chemically functonalize templates," Chemical Physicas Letters, Apr. 2, 1999, 303, 125-129.

Liu et al., "Controlled Growth of Super-Aligned Carbon Nanotube Arrays for Spinning Continuous Unidirectional Sheets with Tunable Physical Properties", Nano Letters, vol. 8, No. 2, pp. 700-705 (2008).

Ma et al., "Directly Synthesized Strong, Highly Conducting, Transparent Single-Walled Carbon Nanotube Films", Nano Letters, vol. 7, No. 8, pp. 2307-2311 (2007).

Nakagawa, et al., "Controlled Deposition of Silicon Nanowires on Chemically Patterned Substrate by Capillary Force Using a Blade-coating Method," *J. Phys. Chem.*, (2008) vol. 112: pp. 5390-5396.

Poulin, et al., "Films and fibers of oriented single wall nanotubes," *Carbon*, 40 (2002) pp. 1741-1749.

Rao et al., "Large-scale assembly of carbon nanotubes", Nature, vol. 425, pp. 36-37, Sep. 4, 2003.

Tang, et al., "Assembly of 1D Nanostructures into Sub-micrometer Diameter Fibrils with Controlled and Variable Length by Dielectrophoresis," *Adv. Mater.*, 15, No. 16, pp. 1352-1355, 2003.

Wang et al., "Controlling the shape, orientation, and linkage of carbon nanotube features with nano affinity templates", PNAS, vol. 103, No. 7, pp. 2026-2031 (2006).

Zhang et al., "Multifunctional Carbon Nanotube Yarns by Downsizing an Ancient Technology", Science, vol. 306, 1358-1361 (2004).

Examiner's answer mailed Jul. 25, 2011 from U.S. Appl. No. 12/192,024, filed Aug. 14, 2008.

Notice of Allowance mailed Mar. 24, 2011 from U.S. Appl. No. 12/198,835, filed Aug. 26, 2008.

Notice of allowance mailed Jun. 15, 2011 from U.S. Appl. No. 12/198,815, filed Aug. 26, 2008.

Arnold, M.S., et al., "Sorting carbon nanotubes by electronic structure using density differentiation", Nature Nanotechnology, vol. 1, pp. 60-65 (2006).

Carroll, D.L., et al., "Polymer—nanotube composites for transparent, conducting thin films," Synthetic Metals, vol. 155, Issue 3, pp. 694-697 (2005).

Meng et al., The Synthesis of MWNTs/SWNTs Multiple Phase Nanowire Arrays in Porous Anodic Aluminum Oxide Templates, Materials Science and Engineering: A, vol. 354, Issue 1-2, pp. 92-96 (2003).

Valentini, L., and Kenny, J.M., "Novel approaches to developing carbon nanotube based polymer composites: fundamental studies and nanotech applications," Polymer, vol. 46, Issue 17, pp. 6715-6718 (2005).

Yong II Song et al., "Fabrication of Carbon Nanotube Filed Emitters Using a Dip-Cating Method," Chemical Vapor Deposition, vol. 12, pp. 375-379.

* cited by examiner

DMF_CNT_rope + Cu electroplating_$10^{-8}$ C

DMF_CNT_rope + Cu electroplating_$10^{-9}$ C

MANUFACTURING CARBON NANOTUBE ROPES

CROSS-REFERENCE TO RELATED APPLICATIONS

This application claims the benefit of Korean Patent Application No. 10-2008-0020122, filed on Mar. 4, 2008; and Korean Patent Application No. 10-2008-0085539, filed on Aug. 29, 2008, the entire disclosures of which are incorporated by reference.

TECHNICAL FIELD

The present disclosure relates generally to carbon nanotubes (CNTs), more particularly to manufacturing CNT ropes.

BACKGROUND

Recently, CNTs have attracted great attention in many research areas due to their superior mechanical, thermal and electrical properties that make them potentially useful in various applications in nanotechnology, electronics, optics and other fields.

CNTs are generally synthesized by chemical vapor deposition (CVD), laser ablation or arc discharge, and are categorized as single-walled nanotubes (SWNTs) and multi-walled nanotubes (MWNTs). MWNTs include concentric cylinders with the smallest cylinder in the middle immediately surrounded by a larger cylinder which in turn is immediately surrounded by an even larger cylinder. Here, each cylinder represents a "wall" of the CNT, hence giving the name "multi-walled" nanotubes.

CNTs are one of the strongest and stiffest materials known and can be applied, for example, to manufacture fibers for ultra high strength composites that can be used in various applications traditionally served by conventional polymer-based fibers.

To harness the outstanding mechanical properties of CNTs, the development of simpler and more efficient synthesis techniques for producing arrays of CNTs is vital to the future of carbon nanotechnology and to apply this technology to commercial-scale applications.

SUMMARY

Embodiments of CNT rope manufacturing techniques are disclosed herein. In accordance with one embodiment by way of non-limiting example, a CNT assembly manufacturing method includes preparing a metal tip, preparing a CNT colloid solution, immersing the metal tip into the CNT colloid solution; and withdrawing the metal tip from the CNT colloid solution.

In another embodiment, the present disclosure provides a method of manufacturing cold cathodes comprising the CNT ropes described above.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
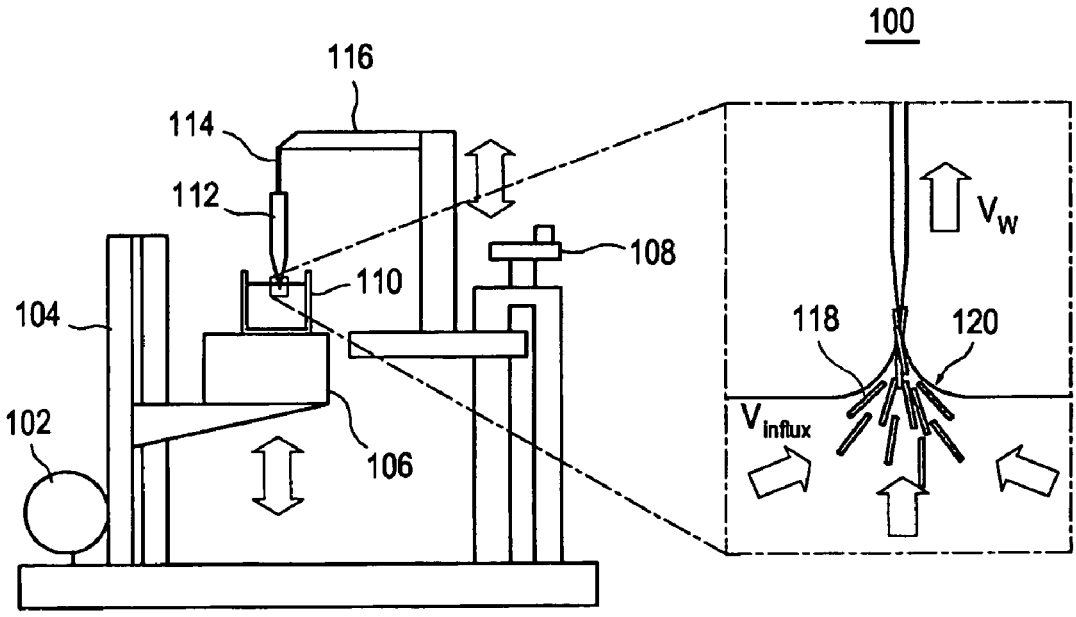
FIG. 1 shows a schematic of an illustrative embodiment of a CNT rope manufacturing system.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

This disclosure is drawn, inter alia, to methods, apparatus, computer programs and systems related to carbon nanotubes.

Referring to FIG. 1, an illustrative embodiment of a carbon nanotube (CNT) assembly manufacturing system 100 is shown. In some embodiments, the CNT assembly manufacturing system 100 optionally includes one or more of a motor 102, a guider 104, a stage 106, a manipulator 108, a vessel 110, a metal tip 112, a holder 114, and a hanger 116. The metal tip 112 is held by the holder 114 (e.g., chuck, collet, etc.) which is in turn attached to the hanger 116. The metal tip 112 is immersed into a CNT colloidal solution that is contained in the vessel 110. For example, a user may operate the manipulator 108 to move the position of the metal tip 112 to immerse the metal tip 112 into the CNT colloidal solution.

The metal tip 112 may be immersed in the CNT colloidal solution for a predetermined time period, such as from about 1 second to about 20 seconds. In some embodiments, the above predetermined period may range from about 1 second to about 20 seconds, from about 2 seconds to about 20 seconds, from about 5 seconds to about 20 seconds, from about 7.5 seconds to about 20 seconds, from about 10 seconds to about 20 seconds, from about 15 seconds to about 20 seconds, from about 0.5 seconds to about 1 second, from about 0.5 seconds to about 2 seconds, from about 0.5 seconds to about 5 seconds, from about 0.5 seconds to about 7.5 seconds, from about 0.5 seconds to about 10 seconds, from about 0.5 seconds to about 15 seconds, from about 1 second to about 2 seconds, from about 2 seconds to about 5 seconds, from about 5 seconds to about 7.5 seconds, from about 7.5 seconds to about 10 seconds, or from about 10 seconds to about 15 seconds. In other embodiments, the predetermined period may be about 0.5 seconds, about 1.0 second, about 5.0 seconds, about 7.5 seconds, about 10 seconds, about 15 seconds, or about 20 seconds.

The user may operate the manipulator 108 to drive the motor 102 so that the stage 106 moves along the guider 104. In this way, the stage 106 may move downward at a predetermined speed relative to the metal tip 112, and thus, the metal tip 112 can be withdrawn from the CNT colloidal solution at a certain withdrawal velocity ($V_w$).

The raising motion of the metal tip 112 may be accomplished at any effective speed that may be determined according to the viscosity of the CNT colloidal solution. As the viscosity of the CNT colloidal solution increases or the target diameter of the CNT rope becomes smaller, the raising speed of the metal tip 112 may be higher. As the metal tip 112 is withdrawn further from the CNT colloidal solution, the raising speed of the metal tip 112 may vary, or otherwise remain constant.

In some embodiments, the raising speed of the metal tip 112 may range from about 0.1 mm/minute to about 2.0 mm/minute, from about 0.25 mm/minute to about 2.0 mm/minute, from about 0.5 mm/minute to about 2.0 mm/minute, from about 0.75 mm/minute to about 2.0 mm/minute, from about 1.0 mm/minute to about 2.0 mm/minute, from about 1.25 mm/minute to about 2.0 mm/minute, from about 1.5 mm/minute to about 2.0 mm/minute, from about 1.75 mm/minute to about 2.0 mm/minute, from about 0.1 mm/minute to about 1.5 mm/minute, from about 0.1 mm/minute to about 1.25 mm/minute, from about 0.1 mm/minute to about 1.0 mm/minute, from about 0.1 mm/minute to about 0.75 mm/minute, from about 0.1 mm/minute to about 0.5 mm/minute, or from about 0.1 mm/minute to about 0.25 mm/minute. In other embodiments, the raising speed of the metal tip 112 may be a constant value of, e.g., about 0.1, 0.2, 0.3, 0.5, 0.7, 0.9, 1.0, 1.25, 1.5, 1.75, or 2 mm/minute.

In the present disclosure, different approaches for achieving a raising motion of the metal tip 112 with respect to the CNT colloidal solution are made use of. One approach is to move either the metal tip 112 while the position of the stage 106 is unchanged, or the other way around. An additional degree of freedom in their relative movement can be achieved if the metal tip 112 and the stage 106 are moved in concert.

In some embodiments, the metal tip 112 can be withdrawn at a certain direction relative to the surface of the CNT colloidal solution. For example, the metal tip 112 may be withdrawn following a line perpendicular to the surface of the CNT colloidal solution so that the CNT rope may have a uniform density along the circumference of the CNT rope. In some embodiments, the metal tip 112 may be rotated while being withdrawn from the colloidal solution. In this way, the CNT colloids may be extended in a helical fashion, resulting in a more stiff CNT rope. The CNT assembly manufacturing system 100 may be operated under predetermined ambient conditions. For example, the metal tip processing may be performed at room temperature (i.e., 20 to 30° C.), at relative humidity of 30%, and at atmospheric pressure (i.e., 1 atm).

Figure 2:
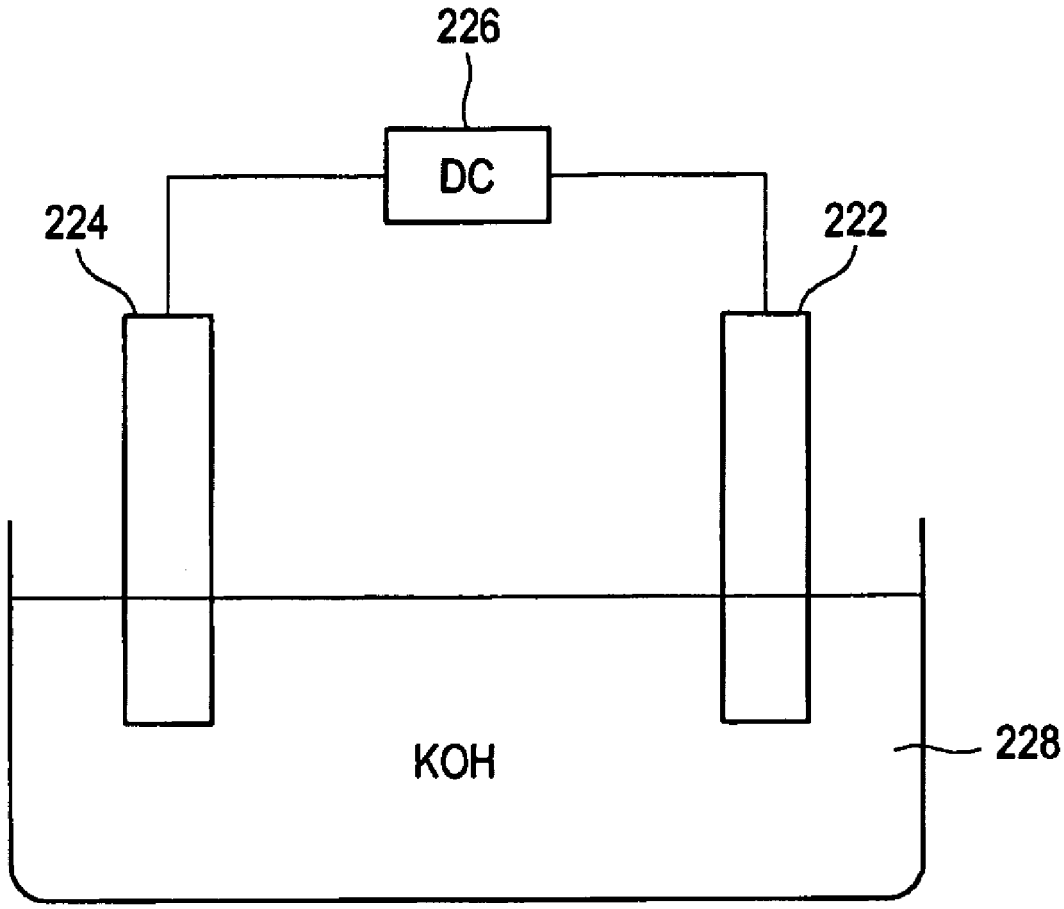
FIG. 2 shows an illustrative embodiment of a method for performing electrochemical etching of a metal tip.

Referring to FIG. 2, one illustrative example of performing an electrochemical etching process of a metal tip is shown. In some embodiments, an electrochemical etching method may be performed to etch a metal rod/wire, thereby obtaining a sharp metal tip for use in a CNT assembly manufacturing system. In one example of the electrochemical etching method, a tungsten rod 222 and a platinum rod 224 may be used as an anode and cathode, respectively, for the electrochemical etching. A suitable voltage from a DC power source 226 may be applied between the tungsten rod 222 and platinum rod 224. As shown in FIG. 2, the tungsten rod 222 and the platinum rod 224 are immersed in an electrolyte. For example, KOH (Potassium hydroxide) or NaOH (Sodium hydroxide) solution may be used as an electrolyte. The application of a predetermined voltage between the tungsten rod 222 and platinum rod 224 which are immersed into the electrolyte (e.g., KOH solution 228) results in the following anodic oxidation reaction:

$$W+6OH^- \rightarrow WO_3(S)+3H_2O+6e^- \quad \text{(1st)}$$

$$WO_3(S)+2OH^- \rightarrow WO_4^{2-}+H_2O \quad \text{(2nd)}$$

In this way, an electrochemical etching process is performed to make the metal rod/wire etched to form the sharp metal tip that is used in a CNT assembly manufacturing system.

Figure 3:
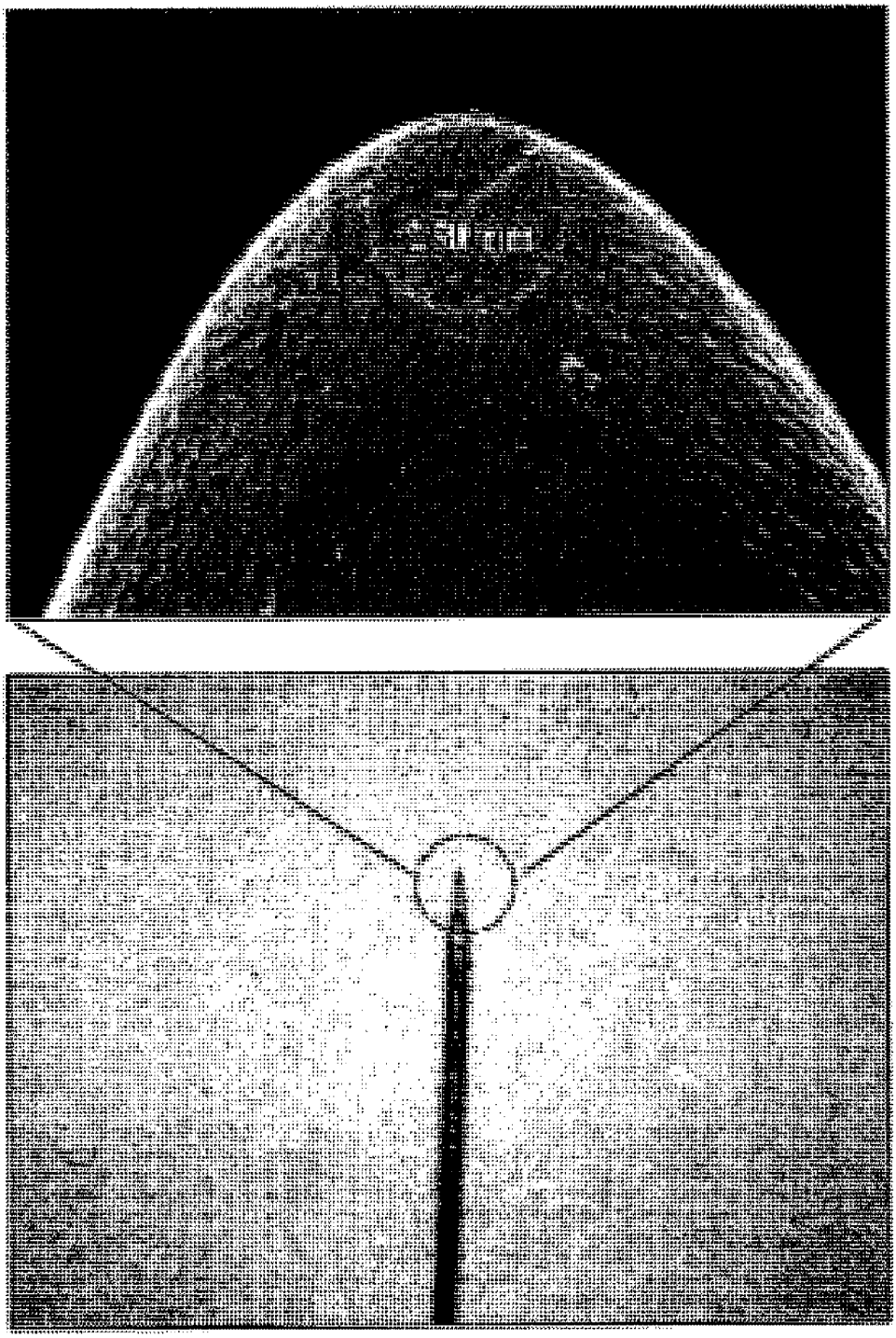
FIG. 3 shows an illustrative embodiment of an etched metal tip.

Referring to FIG. 3, an illustrative example of an etched metal tip 112 used in one or more embodiments is shown. As a material for the metal tip 112, a metal that has good wettability with the CNT colloidal solution, e.g., tungsten (W) may be used. In one embodiment, the metal tip material may comprise one or more of tungsten, tungsten alloy, platinum, platinum alloy, and the like. The sharpness of a tip is related to the radius of curvature of the cone shape of the tip: the smaller the radius of curvature, the sharper the tip. Depending on the design requirements and/or the application area of the metal tip 112, the metal tip 112 may have various shapes and tip apexes. For example, as shown in FIG. 3, the metal tip 112 may have the shape of cone having a tip apex radius of less than or equal to about 250 nm, thereby forming a sharp conical-shape as shown in an upper side figure, i.e., enlarged figure of the apex portion of the metal tip 112.

Depending on the design requirements, the metal tip 112 may have other shapes including a pyramid, a column, a plate and the like, with a tip apex radius ranging from tens of nanometers to hundreds of nanometers, such as from about 10 nm to about 700 nm, from about 25 nm to about 700 nm, from about 50 nm to about 700 nm, from about 75 nm to about 700 nm, from about 100 nm to about 700 nm, from about 150 nm to about 700 nm, from about 200 nm to about 700 nm, from about 300 nm to about 700 nm, from about 500 nm to about 700 nm, from about 10 nm to about 200 nm, from about 20 nm to about 200 nm, from about 40 nm to about 200 nm, from about 75 nm to about 200 nm, from about 100 nm to about 200 nm, from about 10 nm to about 100 nm, from about 10 nm to about 90 nm, from about 10 nm to about 75 nm, from about 10 nm to about 50 nm, from about 10 nm to about 25 nm. In other embodiments, the metal tip 112 may have a constant tip apex radius of about 10 nm, about 25 nm, about 50 nm, about 75 nm, about 100 nm, about 150 nm, about 175 nm, about 200 nm, about 300 nm, about 400 nm, about 500 nm, about 600 nm, or about 700 nm. The sharpness of a tip is related to the radius of curvature of the cone shape of the tip: the smaller the radius of curvature, the sharper the tip and the higher the yield of carbon nanotube ropes becomes.

The CNT colloidal solution is prepared by dispersing purified CNTs in a solvent such as D.I. (De-Ionized) water, an organic solvent such as dimethylformamide (DMF), dimethyl sulfoxide (DMSO), tetrahydrofuran (THF) or the like. The CNT may include single-walled nanotubes (SWNTs) and multi-walled nanotubes (MWNTs). Since nanotubes produced by the methods currently available may contain impurities, they may need to be purified before being formed into the colloid solution (Alternatively, purified CNTs can be purchased directly). A suitable purification method may comprise refluxing in nitric acid (e.g., about 2.5 M or 3.0 M) and re-suspending the nanotubes in water (e.g., pH 10 or pH 9) with surfactant (e.g., sodium lauryl sulfate), and then filtering the nanotubes with a cross-flow filtration system. The resulting purified nanotube suspension can then be passed through a filter (e.g., polytetrafluoroethylene filter).

In some embodiments, the purified CNTs may be in powder form that can be dispersed into the solvent. Any dispersion technique to disperse powder of nano size may be used, including but not limited to homogenization, blending and probe sonication. In one or more embodiments, an ultrasonication treatment can be carried out to facilitate dispersion of the purified CNTs throughout the solvent, and/or an electrical field may be applied to cause the purified CNTs to be dispersed throughout the solvent.

Referring back to FIG. 1, the manipulator 108 operates the hanger 116 and the holder 114 to allow the metal tip 112 (e.g., tungsten wire) to be immersed into the CNT colloid solution contained in the vessel 110. The vessel 110 may be formed of or coated with a hydrophobic material, such as Teflon or other PTFE (polytetrafluoroethylene) substances. In some embodiments, the CNT colloidal solution may be mixed with polymers such as epoxy, polyvinylalcohol (PVA), polyimide (PI), polystyrene (PS), polyacrylate (PAC), and the like. In this way, CNT ropes will form CNT/polymer composites (e.g., CNT impregnated with polymer). In some embodiments, formation of CNT/polymer composites results in CNT ropes with increased overall mechanical strength.

For the above-described configuration of the carbon nanotube (CNT) assembly manufacturing system 100, CNT array formation is illustratively shown at the air-solution-tip interface in a dotted box of FIG. 1 (see right side of FIG. 1). Although not wishing to be limited by reliance on a particular mechanism, in this illustrative embodiment, an influx flow ($V_{influx}$) of the CNT colloids 118 occurs toward the metal tip 112 due to a meniscus 120 whose shape is determined by the interfacial energy among the air, solution and the metal tip 112. The influx flow of the CNT colloids 118 may be facilitated by applying heat to the CNT colloids 118. In some embodiments, the influx flow of the CNT colloids 118 may range from about 1 cm/hour to about 9 cm/hour, from about 2 cm/hour to about 9 cm/hour, from about 3 cm/hour to about 9 cm/hour, 4 cm/hour to about 9 cm/hour, 5 cm/hour to about 9 cm/hour, 6 cm/hour to about 9 cm/hour, 7 cm/hour to about 9 cm/hour, 8 cm/hour to about 9 cm/hour, 1 cm/hour to about 5 cm/hour, 1 cm/hour to about 2.5 cm/hour, or 1 cm/hour to about 1.5 cm/hour. In other embodiments, the influx flow of the CNT colloids 118 may be a constant value such as about 1 cm/hour, about 2 cm/hour, about 3 cm/hour, about 5 cm/hour, about 7 cm/hour, or about 9 cm/hour.

The CNT colloids 118 induced by capillary action adhere to the apex of the metal tip 112 to form a CNT array. As the metal tip 112 is withdrawn from the colloidal solution, the CNT array is extended at the end of the metal tip 112. The CNTs dispersed in the CNT colloid solution adhere together due to van der Waals forces, thereby forming the continuous CNT array. In this way, the CNT assembly is obtained by withdrawing the metal tip 112 from the CNT colloidal solution. The above mechanism may be one of various possible and conceivable mechanisms responsible for the high yield and selectivity of carbon nanotube ropes in the present disclosure, and this mechanism is utilized as merely an explanation of the results of the present disclosure.

Figure 4:
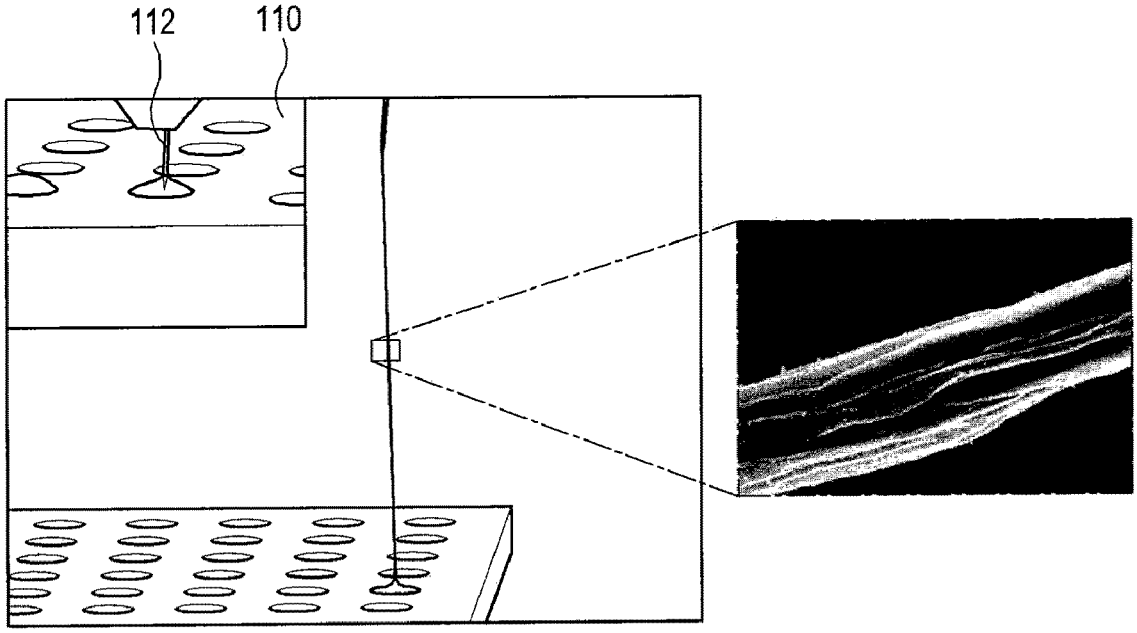
FIG. 4 shows an illustrative embodiment of a detailed process for manufacturing a CNT rope.

Referring to FIG. 4, an illustrative example of a more detailed process of manufacturing the CNT rope is shown. In some embodiments, a plurality of vessels 110 may contain the CNT colloid solution so that the CNT rope manufacturing method of the present disclosure may be carried out in parallel by using a plurality of the metal tips 112.

In some embodiments, the resulting CNT ropes may have a length and diameter of, e.g., about 1 cm and 10 μm, respectively. The length of the CNT ropes may be made longer, e.g., from about 10 cm or even longer, as long as the CNT colloidal solution is continuously supplied. In some embodiments, the length of the CNT ropes may range from about 0.5 cm to about 20 cm, from about 1 cm to about 20 cm, from about 1.5 cm to about 20 cm, from about 2.5 cm to about 20 cm, from about 5 cm to about 20 cm, from about 7.5 cm to about 20 cm, from about 10 cm to about 20 cm, from about 12.5 cm to about 20 cm, from about 15 cm to about 20 cm, from about 17.5 cm to about 20 cm, from about 0.5 cm to about 10 cm, from about 0.5 cm to about 7.5 cm, from about 0.5 cm to about 5.0 cm, from about 0.5 cm to about 2.5 cm, or from about 0.5 cm to about 1 cm, and the diameter of the CNT ropes may range from about 5 μm to about 30 μm, from about 10 μm to about 30 μm, from about 20 μm to about 30 μm, from about 5 μm to about 20 μm, from about 5 μm to about 15 μm, or from about 5 μm to about 10 μm. Moreover, CNT ropes of the present disclosure can be further extended by again immersing the ends (i.e., nodes) of the CNT ropes into the CNT colloidal solution and withdrawing the CNT ropes. For example, multiple CNT ropes may be connected together to form an extended CNT rope having a length of about 10 cm, about 25 cm, about 50 cm, about 100 cm or even longer. In this way, it is possible produce CNT ropes in a simple and efficient fashion with high yields and low costs.

In some embodiments, to further enhance the characteristics of the CNT ropes according to their uses, various post-treatments may be employed without limitation, including polymer mixing, UV-irradiation, thermal annealing, electroplating, and the like.

Further, in accordance with the present disclosure, there is provided a cold cathode comprising the CNT rope described above. To manufacture the cold cathode, a CNT rope is attached to the sharp end of a metal tip by using various techniques such as dip-coating, dielectrophoresis, electrophoresis, and the like. For example, a metal, e.g., tungsten that has good wettability with the CNT colloidal solution may be used as the metal tip. In some embodiments, the CNT rope can be electroplated to add reinforcement for mechanical stiffness and electrical conductivity of the CNT rope.

A suitable electroplating method may comprise immersing a CNT rope manufactured in accordance with the present disclosure into an electroplating solution to perform electroplating on the CNT rope. An electric potential is applied across two electrodes that are immersed in an organic dispersion of CNTs, so that the CNT rope immersed in the electroplating solution is deposited with the metal in the electroplating solution. The electroplating process may be performed under the predetermined ambient conditions. For example, the electroplating process may be performed at room temperature (i.e., from about 20° C. to 30° C.), and at atmospheric pressure (i.e., 1 atm). It should be appreciated that the ambient conditions may vary depending on various factors such as the types of electroplating metal and electroplating solutions, amplitude of electric field and the like. Various types of metals may be used for forming the electroplating solution, including, but not limited to, Cu, Ni, W, Ti, In or the like. In some embodiments, electroplated metal functions as bridges between CNTs, thereby increasing adhesion between individual CNTs within a CNT rope. In some embodiments, the electroplated metal may increase adhesion between the CNT rope and the metal tip to which the CNT rope is attached.

Figure 5:
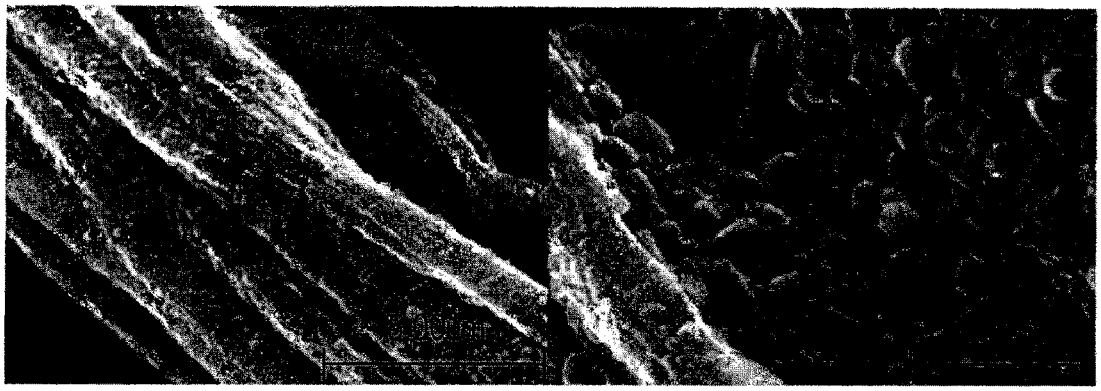
FIG. 5 shows an illustrative embodiment of a microscopic image of a CNT rope electroplated with copper.
Figure 5:
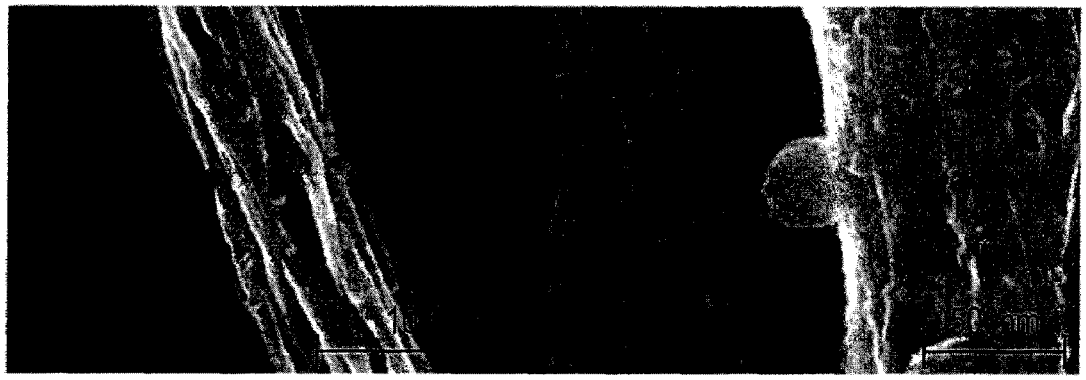

FIG. 5 is a microscopic image of an illustrative CNT rope taken by using a scanning electron microscope, showing the CNT rope electroplated with copper. In some embodiments, the CNT rope is made from the above-described process by using the CNT colloidal solution, e.g., dimethylformamide (DMF), and a metal, e.g., Cu is used as an electroplating metal. For example, an organic solvent such as DMF, Dimethyl sulfoxide (DMSO), Tetrahydrofuran (THF) or the like may be used as the CNT colloidal solution, and various metals such as Cu, Ni, W, Ti, In or the like may be used as an electroplating metal. In some embodiments, a current that is applied to the CNT rope for a certain time (e.g., a second) is $10^{-8}$ A/sec (i.e., $10^{-8}$ C); in another embodiment, $10^{-9}$ C is applied to the CNT rope. The current level applied during the electroplating process may vary with the amount of metal to be electroplated to the CNT rope, ranging from about $10^{-12}$ A/sec to about $10^{-7}$ A/sec, about $10^{-11}$ A/sec to about $10^{-8}$ A/sec, about $10^{-10}$ A/sec to about $10^{-9}$ A/sec or the like. The upper and lower images of FIG. 5 show the CNT ropes of the present disclosure electroplated at $10^{-8}$ C and $10^{-9}$ C, respectively. The amount (including density and size) of metal particles that are electroplated on the CNT rope can be controlled by varying the current level applied to the CNT rope. That is, as the current level is raised, the amount of metal electroplated on the CNT rope would increase, thereby increasing the density and size of the metal particles.

Figure 6:
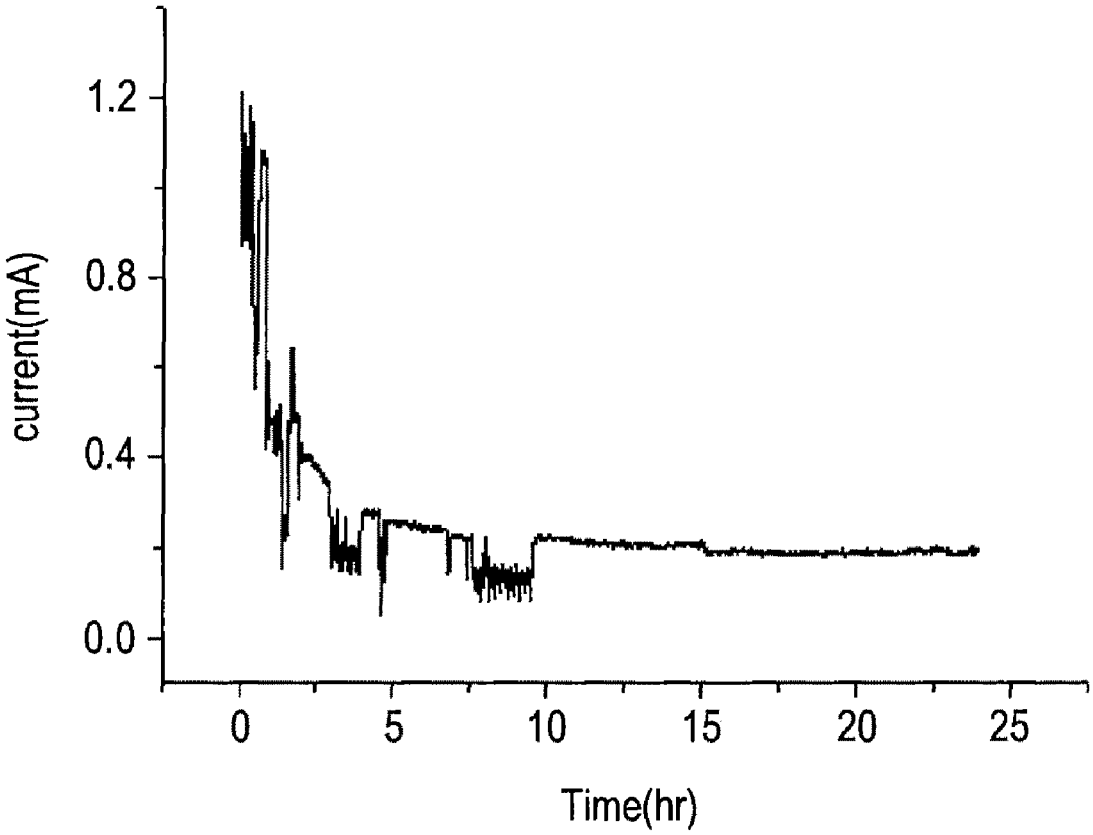
FIG. 6 shows an illustrative embodiment of a graph illustrating a field emission lifetime test of an electroplated CNT rope.

FIG. 6 is a graph of an illustrative embodiment showing a field emission lifetime test of an electroplated CNT rope prepared in accordance with the present disclosure. The CNT rope is electroplated and is used to form an electrical field device which emits an electrical field of, e.g., 1.5 V/μm. In some embodiments, the electrical field applied may range from about 1 V/μm to about 5 V/μm, from about 0.5 V/μm to about 4 V/μm, or from about 1.2 V/μm to about 3 V/μm. For example, as shown in FIG. 6, a current level according to the electric field emission is measured for a predetermined time (e.g., about 25 hours) to perform a field emission lifetime test. For the test, the electric field device may be inserted into a vacuum-sealed vessel in a vacuum (e.g., pressure lower than or equal to $10^{-6}$ Torr, $10^{-7}$ Torr, or the like) or inert gas atmosphere. The CNT rope is disposed as a cathode (emitter) and a collector is placed as an anode, separated by a predetermined gap. A voltage is applied between the CNT rope and the collector to cause electrons to be emitted from the end of the CNT rope to move toward the collector, thereby generating a current. As shown in FIG. 6, the current is measured to obtain a graph illustrating current changes over time. In some embodiments, as illustrated in FIG. 6, the current level has an initial value of about 1.2 mA and decays down to about 0.2. mA. Considering the cross-sectional area of the CNT rope used, the initial and decayed currents of 1.2 mA and 0.2 mA may be equivalent to the current densities of 3000 A/cm$^2$ and 500 A/cm$^2$, respectively for the given electrical field of, e.g., 1.5 V/μm.

Figure 7:
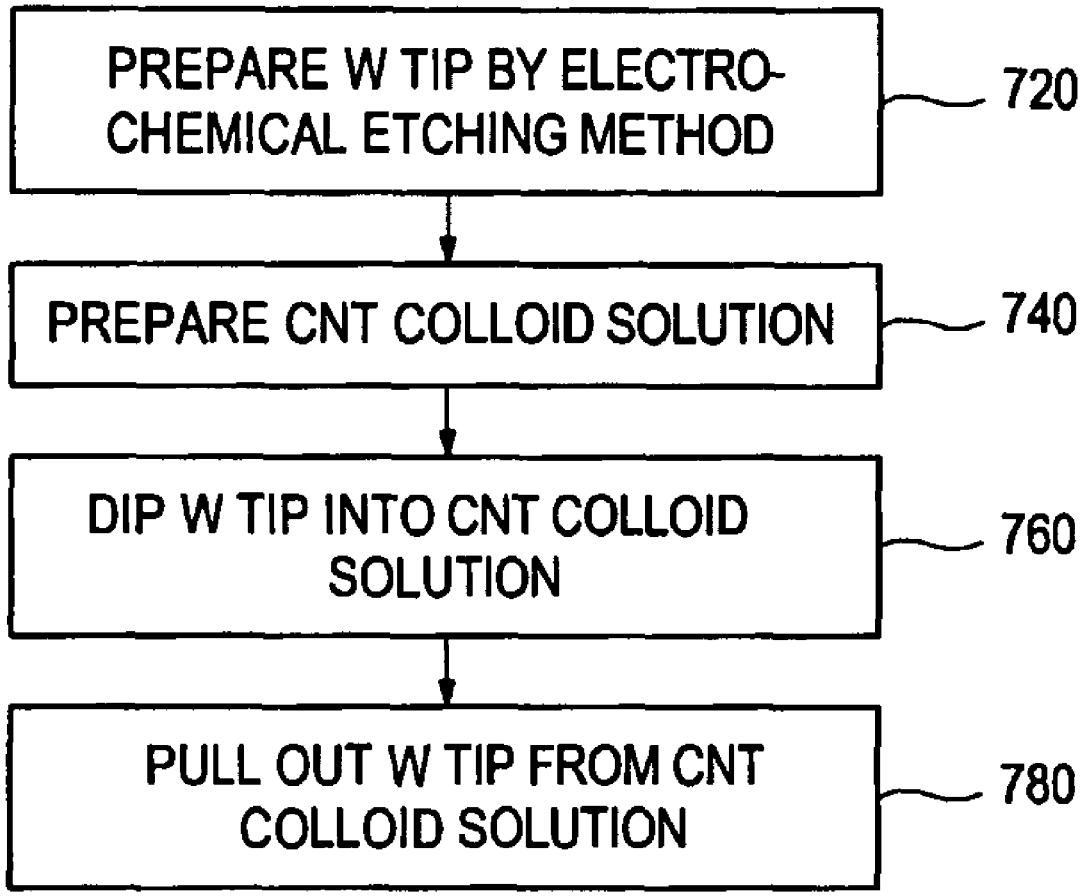
FIG. 7 is a flow chart of an illustrative embodiment of a method for manufacturing a CNT rope.

FIG. 7 shows an operational flow representing an illustrative embodiment of operations related to manufacturing a carbon nanotube (CNT) rope. In FIG. 7 and in the following figure that includes various illustrative embodiments of operational flows, discussion and explanation may be provided with respect to apparatus and method described herein, and/or with respect to other examples and contexts. The operational flow may be executed in a variety of other contexts and environments, and/or in modified versions of those described herein. In addition, although some of the operational flows are presented in sequence, the various operations may be performed in various repetitions, concurrently, and/or in other orders than those that are illustrated.

Initially at operation 720, a metal tip is prepared by performing, e.g., an electrochemical etching process. As a material for the metal tip 112, a metal that has good wettability with the CNT colloidal solution, e.g., tungsten (W) may be used. In one embodiment, the metal tip material may comprise one or more of tungsten, tungsten alloy, platinum, platinum alloy, and the like.

Depending on the design requirements and/or the application area of the metal tip 112, the metal tip 112 may have various shapes and tip apexes. The radius of apex of a manufactured tungsten tip may vary from tens of nanometers to hundreds of nanometers, ranging from about 50 nm to about 600 nm. For example, as shown in FIG. 3, the metal tip 112 may have a sharp conical-shape with a tip apex radius of less than or equal to about 250 nm. Depending on the design requirements, the metal tip 112 may have other shapes including a pyramid, a column, a plate and the like, with a tip apex radius ranging from tens of nanometers to hundreds of nanometers, such as from about 10 nm to about 700 nm, from about 25 nm to about 700 nm, from about 50 nm to about 700 nm, from about 75 nm to about 700 nm, from about 100 nm to about 700 nm, from about 150 nm to about 700 nm, from about 200 nm to about 700 nm, from about 300 nm to about 700 nm, from about 500 nm to about 700 nm, from about 10 nm to about 200 nm, from about 20 nm to about 200 nm, from about 40 nm to about 200 nm, from about 75 nm to about 200 nm, from about 100 nm to about 200 nm, from about 10 nm to about 100 nm, from about 10 nm to about 90 nm, from about 10 nm to about 75 nm, from about 10 nm to about 50 nm, from about 10 nm to about 25 nm. In other embodiments, the metal tip 112 may have a constant tip apex radius of about 10 nm, about 25 nm, about 50 nm, about 75 nm, about 100 nm, about 150 nm, about 175 nm, about 200 nm, about 300 nm, about 400 nm, about 500 nm, about 600 nm, or about 700 nm. The sharpness of a tip is related to the radius of curvature of the cone shape of the tip: the smaller the radius of curvature, the sharper the tip and the higher the yield of carbon nanotube ropes becomes.

At operation 740, the CNT colloidal solution is prepared by dispersing purified CNTs in a solvent such as D.I. water, an organic solvent such as DMF, DMSO, THF or the like. Since nanotubes produced by the methods currently available may contain impurities, they may need to be purified before being formed into the colloid solution (Alternatively, purified CNTs can be purchased directly). The purified CNTs may be in powder form that can be dispersed into the solvent. Any dispersion technique to disperse powder of nano size may be used, including but not limited to homogenization, blending and probe sonication. In one or more embodiments, an ultrasonication treatment can be carried out to facilitate dispersion of the purified CNTs throughout the solvent. In this way, a well-dispersed and stable CNT colloidal solution is prepared.

At operation 760, the metal tip 112 (e.g., tungsten tip) is immersed into the CNT colloid solution. In some embodiments, as shown in FIG. 1, the manipulator 108 operates the hanger 116 and the holder 114 to allow the metal tip 112 (e.g., tungsten wire) to be immersed into the CNT colloid solution contained in the vessel 110. The vessel 110 may be formed of or coated with a hydrophobic material, such as Teflon or other PTFE (polytetrafluoroethylene) substances. In some embodiments, the CNT colloidal solution may be mixed with polymers such as epoxy, polyvinylalcohol (PVA), polyimide (PI), polystyrene (PS), polyacrylate (PAC), and the like. In this way, CNT ropes will form CNT/polymer composites (e.g., CNT impregnated with polymer). In some embodiments, formation of CNT/polymer composites results in CNT ropes with increased overall mechanical strength.

At operation 780, the metal tip is withdrawn from the colloid solution. In some embodiments, the manipulator 108 operates the motor 102 to move the stage 106 downward at a certain speed so that the metal tip 112 can be withdrawn from the CNT colloid solution at a given withdrawal velocity ($V_w$). Alternatively or simultaneously, the manipulator 108 may operate the hanger 116 and the holder 114 to move the metal tip 112 upward. As the metal tip 112 is pulled out from the colloidal solution, the CNT rope is extended at the end of the metal tip 112. The CNTs dispersed in the CNT colloid solution adhere together due to van der Waals forces, thereby forming the CNT rope. In this way, the CNT rope is obtained by withdrawing the metal tip 112 from the CNT colloidal solution.

In some embodiments, the metal tip 112 can be withdrawn at a certain direction relative to the surface of the CNT colloidal solution. For example, the metal tip 112 may be withdrawn following a line perpendicular to the surface of the CNT colloidal solution so that the CNT rope may have a uniform density along the circumference of the CNT rope. In some embodiments, the metal tip 112 may be rotated while being withdrawn from the colloidal solution. In this way, the CNT colloids may be extended in a helical fashion, resulting in a more stiff CNT rope.

The CNT assembly manufacturing system 100 may be operated under predetermined ambient conditions. For example, the metal tip processing may be performed at room temperature (i.e., 20 to 30° C.), at relative humidity of 30%, and at atmospheric pressure (i.e., 1 atm).

Operations 760 and 780 may be performed by executing a computer software program that can be stored on a computer-readable storage medium. The storage medium may include a floppy disk, a hard disk drive, a Compact Disc (CD), a Digital Video Disk (DVD), a digital tape, a computer memory, etc. In some embodiments, the CNT assembly manufacturing system 100 may receive instructions from an operator to adjust various parameters such as ambient conditions, the withdrawal speed and the like.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

Figure 8:
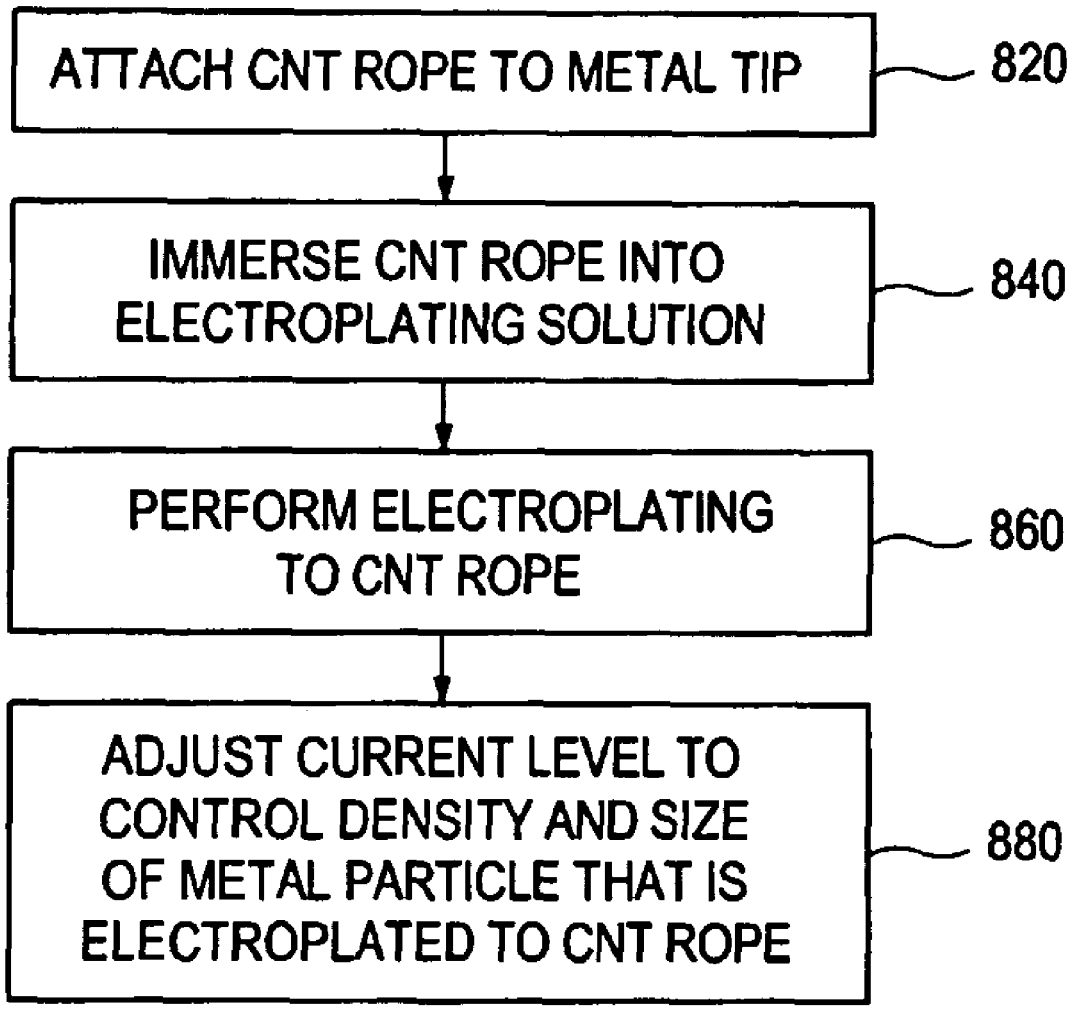
FIG. 8 is a flow chart of an illustrative embodiment for manufacturing a cold cathode.

FIG. 8 shows an operational flow representing an embodiment of operations related to manufacturing a cold cathode. Initially at operation 820, a CNT rope may be attached to the sharp end of a metal tip 112 by using various techniques such as dip-coating, dielectrophoresis, electrophoresis, and the like. For example, a metal, e.g., tungsten, which has good wettability with the CNT colloidal solution may be used as the metal tip. At operation 840, the CNT rope is immersed into an electroplating solution. In particular, the CNT rope may be immersed into the electroplating solution to perform electroplating on the CNT rope. An electric potential is applied across two electrodes that are immersed in a dispersion of CNTs so that the CNT rope in the electroplating solution is electroplated.

At operation 860, the electroplating process is performed to the CNT rope that is immersed in the electroplating solution. Specifically, the CNT rope may be soaked into the electroplating solution to perform the electroplating process to the CNT rope. An electric potential is applied across two electrodes that are immersed in an organic dispersion of CNTs, so that the CNT rope soaked in the electroplating solution is deposited with the metal in the electroplating solution. Various types of metals may be used for forming the electroplating solution, including, but is not limited to, Cu, Ni, W, Ti, In or the like. In some embodiments, a current that is applied to the CNT rope for a certain time (e.g., a second) is $10^{-8}$ A/sec (i.e., $10^{-8}$ C); in another embodiment, $10^{-9}$ C is applied to the CNT rope. The current level applied during the electroplating process may vary with the amount of metal to be electroplated to the CNT rope, ranging from about $10^{-12}$ A/sec to about $10^{-7}$ A/sec, about $10^{-11}$ A/sec to about $10^{-8}$ A/sec, about $10^{-10}$ A/sec to about $10^{-9}$ A/sec or the like. In this way, electroplated metal may function as bridges between CNTs, thereby increasing adhesion between individual CNTs within a CNT rope. Further, the electroplated metal may increase adhesion between the CNT rope and the metal tip to which the CNT rope is attached.

At operation 880, the current level is adjusted to control density and size of metal that is electroplated on the CNT rope. The density and size of the electroplated metal may be controlled by varying the current applied to the CNT rope during the electroplating process. In some embodiments, a current that is applied to the CNT rope for a certain time (e.g., a second) is $10^{-8}$ A/sec (i.e., $10^{-8}$ C); in another embodiment, $10^{-9}$ C is applied to the CNT rope. The upper and lower images of FIG. 5 show the CNT ropes of the present disclosure electroplated at $10^{-8}$ C and $10^{-9}$ C, respectively. The amount (including density and size) of metal particles that are electroplated on the CNT rope can be controlled by varying the current level applied to the CNT rope.

In light of the present disclosure, those skilled in the art will appreciate that the apparatus, and methods described herein may be implemented in hardware, software, firmware, middleware, or combinations thereof and utilized in systems, subsystems, components, or sub-components thereof. For example, a method implemented in software may include computer code to perform the operations of the method. This computer code may be stored in a machine-readable medium, such as a processor-readable medium or a computer program product, or transmitted as a computer data signal embodied in a carrier wave, or a signal modulated by a carrier, over a transmission medium or communication link. The machine-readable medium or processor-readable medium may include any medium capable of storing or transferring information in a form readable and executable by a machine (e.g., by a processor, a computer, etc.).

There is little distinction left between hardware and software implementations of aspects of systems; the use of hardware or software is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method for manufacturing a cold cathode comprising:

immersing a metal tip into a carbon nanotube (CNT) colloid solution, wherein the metal tip has a conical-shaped apex with a radius from about 10 nm to about 700 nm;

withdrawing the metal tip from the CNT colloid solution to form a carbon nanotube (CNT) rope attached to the conical-shaped apex of the metal tip and extending between the metal tip and the CNT colloidal solution, wherein an influx of carbon nanotubes from the CNT colloidal solution occurs towards the metal tip due to a meniscus and the influx is in the range of about 1 cm/hour to about 9 cm/hour;

immersing the CNT rope in an electroplating solution comprising at least one metal; and applying a voltage to the CNT rope to deposit at least a portion of the metal on the CNT rope.

2. The method of claim 1, further comprising:

preparing the metal tip.

3. The method of claim 1, further comprising:

preparing the CNT colloid solution.

4. The method of claim 1, wherein the metal tip comprises tungsten.

5. The method of claim 4, wherein the metal tip comprises metals having high wettability with the CNT colloidal solution.

6. The method of claim 2, wherein preparing the metal tip comprises performing an electrochemical etching process on the metal tip.

7. The method of claim 1, wherein the conical-shaped apex has a radius of less than or equal to about 250 nm.

8. The method of claim 3, wherein preparing a CNT colloid solution includes dispersing purified CNTs in a solvent.

9. The method of claim 8, wherein preparing a CNT colloid solution includes performing an ultrasonication treatment to the CNTs.

10. The method of claim 3, wherein preparing a CNT colloid solution includes adding polymers to the CNT colloid solution.

11. The method of claim 8, wherein the solvent is dimethylformamide (DMF).

12. The method of claim 8, wherein the purified CNTs are in the form of a dispersed powder in the solvent.

13. The method of claim 1, wherein the CNT colloid solution is contained in a vessel that is made of a hydrophobic material.

14. The method of claim 1, wherein the metal tip is withdrawn from the CNT colloid solution at a pre-determined withdrawal velocity.

15. The method of claim 14, wherein the given withdrawal velocity ranges from about 0.2 mm/minute to about 1.0 mm/minute.

16. The method of claim 14, wherein the given withdrawal velocity is about 0.3 mm/minute.

17. The method of claim 1, wherein the CNT rope includes single-walled nanotubes (SWNTs).

18. The method of claim 1, wherein the CNT rope includes multi-walled nanotubes (MWNTs).

19. A method for manufacturing a carbon nanotube (CNT) rope comprising:

immersing a metal tip into a carbon nanotube (CNT) colloidal solution, wherein the metal tip has a conical-shaped apex with a radius from about 10 nm to about 700 nm;

withdrawing the metal tip from the CNT colloidal solution to form a CNT rope attached to the conical-shaped apex of the metal tip and extending between the metal tip and the CNT colloidal solution, wherein an influx of carbon nanotubes from the CNT colloidal solution occurs towards the metal tip due to a meniscus and the influx is in the range of about 1 cm/hour to about 9 cm/hour.

20. The method of claim 19, wherein the metal tip is made of tungsten.

21. The method of claim 1, wherein the CNT rope has a diameter from about 5 μm to about 30 μm.

22. The method of claim 21, wherein the CNT rope has a length from about 0.5 cm to about 20 cm.

* * * * *